US007474864B2

(12) United States Patent
Kobayashi et al.

(10) Patent No.: US 7,474,864 B2
(45) Date of Patent: Jan. 6, 2009

(54) CLEANING DEVICE AND IMAGE FORMING APPARATUS

(75) Inventors: Masanori Kobayashi, Ebina (JP); Mitsuo Yamamoto, Ebina (JP); Yasutomo Ishii, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 245 days.

(21) Appl. No.: 11/501,743

(22) Filed: Aug. 10, 2006

(65) Prior Publication Data

US 2007/0122179 A1 May 31, 2007

(30) Foreign Application Priority Data

Nov. 25, 2005 (JP) ..... 2005-340368

(51) Int. Cl.
*G03G 15/02* (2006.01)

(52) U.S. Cl. ..... 399/100

(58) Field of Classification Search ..... 399/99, 399/100, 176
See application file for complete search history.

(56) References Cited

U.S. PATENT DOCUMENTS 5,678,143 A 10/1997 Nagahara et al.
7,263,308 B2 8/2007 Harada et al.
2005/0063728 A1* 3/2005 Harada et al. ..... 399/100

FOREIGN PATENT DOCUMENTS

| | | |
|---|---|---|
| JP | A-08-62948 | 3/1996 |
| JP | A-2000-122505 | 4/2000 |
| JP | A-2004-361916 | 12/2004 |
| JP | 2005-070750 | 3/2005 |
| KR | 1995-0012163 | 5/1995 |
| KR | 0137091 | 6/1998 |
| KR | 10-0465331 | 1/2005 |

* cited by examiner

*Primary Examiner*—Hoang Ngo
(74) *Attorney, Agent, or Firm*—Morgan, Lewis & Bockius LLP

(57) ABSTRACT

An image forming apparatus includes a member to be cleaned, and a cleaning member, formed by foam material having plural foam cells, that cleans the member to be cleaned by contacting the member to be cleaned and rubbing against the member to be cleaned. In any one of the plural foam cells in a surface of the cleaning member, a maximum length A in a rubbing direction and a maximum length B in a direction orthogonal to the rubbing direction satisfy the relationship of A<B.

7 Claims, 7 Drawing Sheets

CLEANING DEVICE AND IMAGE FORMING APPARATUS

BACKGROUND

1. Technical Field

The present invention relates to an image forming apparatus disposed with a cleaning member that is formed of foam material and cleans a member to be cleaned.

2. Related Art

In an image forming apparatus that uses the electrophotographic system, the surface of a photoreceptor is charged by a charge roll or corotron, the charged surface of the photoreceptor is exposed by an exposure device to form an electrostatic latent image on the photoreceptor, and the electrostatic latent image on the photoreceptor is developed by a developing device. Then, the developed image is transferred from the photoreceptor to an intermediate transfer body or a recording medium, and toner that remains on each component without being transferred is cleaned by a cleaning member such as a blade or a roll.

SUMMARY

According to an aspect of the present invention, an image forming apparatus includes a member to be cleaned, and a cleaning member, formed by foam material having plural foam cells, that cleans the member to be cleaned by contacting the member to be cleaned and rubbing against the member to be cleaned. In any one of the plural foam cells in a surface of the cleaning member, a maximum length A in a rubbing direction and a maximum length B in a direction orthogonal to the rubbing direction satisfy the relationship of A<B.

BRIEF DESCRIPTION OF THE DRAWINGS

Exemplary embodiments of the present invention will be described in detail based on the following figures, wherein.

DETAILED DESCRIPTION

An exemplary embodiment of the present invention will now be described on the basis of the drawings.

Figure 1:
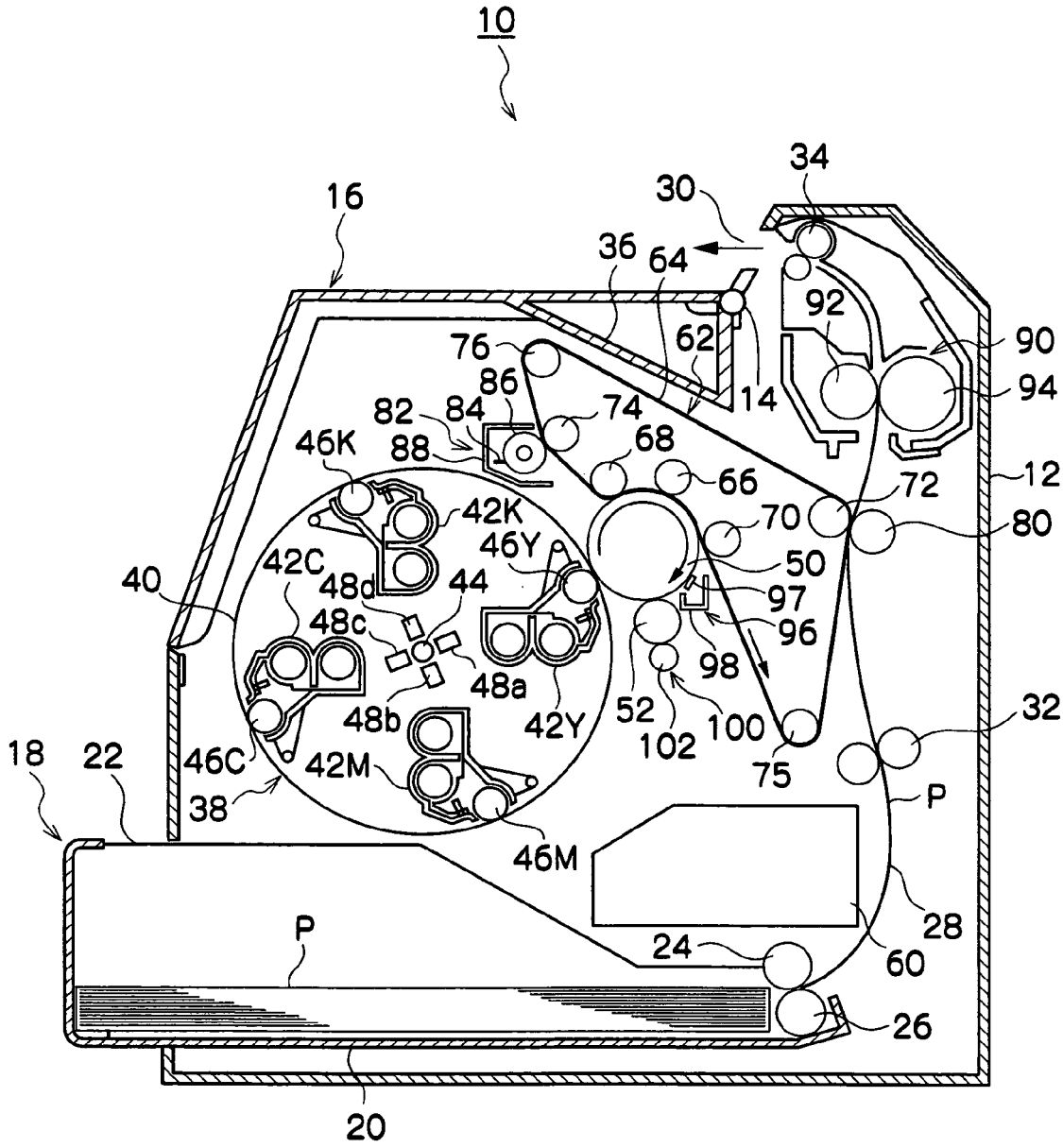
FIG. 1 is a cross-sectional diagram showing an image forming apparatus disposed with a cleaning roll pertaining to the exemplary embodiment of the invention.

FIG. 1 shows an image forming apparatus 10 pertaining to the exemplary embodiment of the invention. The image forming apparatus 10 includes an image forming apparatus body

12. An open/close cover 16 that is pivotable around a pivot point 14 is disposed on an upper portion of the image forming apparatus body 12. A paper supply unit 18 of single cassette, for example, is disposed in a lower portion of the image forming apparatus body 12.

The paper supply unit 18 includes a paper supply unit body 20 and a paper supply cassette 22 in which a paper is accommodated. A feed roll 24, which feeds the paper from the paper supply cassette 22, and a retard roll 26, which sorts the fed paper one sheet at a time, are disposed in the upper vicinity of the deep end of the paper supply cassette 22.

A conveyance path 28 is a paper path from the feed roll 24 to an exit port 30. The conveyance path 28 is formed in the vicinity of the back side (right side in FIG. 1) of the image forming apparatus body 12 substantially vertically from the paper supply unit 18 to a later-described fixing device 90. A later-described second transfer roll 80 and a later-described second transfer backup roll 72 are disposed upstream of the fixing device 90 on the conveyance path 28. A registration roll 32 is disposed upstream of the second transfer roll 80 and the second transfer backup roll 72. An exit roll 34 is disposed in the vicinity of the exit port 30 of the conveyance path 28.

That is, the paper fed by the feed roll 24 from the paper supply cassette 22 of the paper supply unit 18 is sorted by the retard roll 26 such that just the uppermost sheet of paper is guided to the conveyance path 28. The paper is temporarily stopped by the registration roll 32 and then passed at a timing between the second transfer roll 80 and the second transfer backup roll 72, where a toner image is transferred to the paper. Then, the fixing device 90 fixes the transferred toner image to the paper, and the paper is exited by the exit roll 34 through the exit port 30 to an exit unit 36 disposed in the upper portion of the open/close cover 16. The exit port portion of the exit unit 36 is low, and the exit unit 36 slants such that it gradually becomes higher toward the front direction (left direction in FIG. 1).

A rotary developing device 38 is disposed in the substantially central portion, for example, of the image forming apparatus body 12. The rotary developing device 38 includes a developing unit body 40 disposed with developing units 42Y to 42K that respectively form toner images of the four colors of yellow (Y), magenta (M), cyan (C), and black (K), and the rotary developing device 38 rotates leftward (counterclockwise in FIG. 1) around a rotary developing device center 44. The developing units 42Y to 42K include developing rolls 46Y to 46K and are pressed in the normal line direction of the developing unit body 40 by elastic bodies 48*a* to 48*d* which may be coil springs, for example.

The developing units 42Y to 42K are disposed in the rotary developing device 38 such that a photoreceptor drum 50 contacts the developing rolls 46Y to 46K. Part of the outer peripheries of the developing rolls 46Y to 46K protrude (e.g., 2 mm) in the radial direction from the outer periphery of the developing unit body 40 in a state where they are not contacting the photoreceptor drum 50. Further, tracking rolls (not shown) that have diameters slightly larger than the diameters of the developing rolls 46Y to 46K are disposed at both ends of each of the developing rolls 46Y to 46K such that the tracking rolls rotate coaxially with the developing rolls 46Y to 46K. In other words, the developing rolls 46Y to 46K of the developing units 42Y to 42K are centered around the rotary developing device center 44 and disposed at the outer periphery of the developing unit body 40 at 90° intervals, the tracking rolls of the developing rolls 46Y to 46K contact flanges (not shown) disposed on both ends of the photoreceptor drum 50 to form predetermined gaps between the developing rolls 46Y to 46K and the photoreceptor drum 50, and the developing rolls 46Y to 46K develop the latent image on the photoreceptor drum 50 with toners of the respective colors.

A charge roll 52 that uniformly charges the photoreceptor drum 50 is disposed below the photoreceptor drum 50. An exposure device 60 that uses a light beam such as a laser beam to write the latent image on the photoreceptor drum 50 charged by the charge roll 52 is disposed at the rear side of, and below, the rotary developing device 38. Further, an intermediate transfer device 62, to which the toner image visualized by the rotary developing device 38 is primarily transferred at a first transfer position and which conveys the toner image to a later-described second transfer position, is disposed above the rotary developing device 38.

The intermediate transfer device 62 includes an intermediate transfer belt 64, a first transfer roll 66, a wrap-in roll 68, a wrap-out roll 70, the second transfer back roll 72, a brush backup roll 74, and tension rolls 75 and 76.

The intermediate transfer belt 64 has elasticity, for example, and is stretched substantially flatly above the rotary developing device 38. The edge of the upper surface side of the intermediate transfer belt 64 is stretched such that it is substantially parallel to the exit unit 36 disposed in the upper portion of the image forming apparatus 12, for example. Further, the intermediate transfer belt 64 includes a first transfer portion (photoreceptor drum wrap region) that contacts the photoreceptor drum 50 in a wrapped manner between the wrap-in roll 68 disposed upstream of the first transfer roll 66 under the intermediate transfer belt 64 and the wrap-out roll 70 disposed downstream of the first transfer roll 66, is wrapped around a predetermined region of the photoreceptor drum 50, and follows the rotation of the photoreceptor drum 50. For this reason, a dedicated drive source for causing the intermediate transfer belt 64 to be rotatingly driven becomes unnecessary, so that costs may be reduced.

In this manner, the toner images on the photoreceptor drum 50 are superposed and primarily transferred by the first transfer roll 66 to the intermediate transfer belt 64 in the order of yellow, magenta, cyan, and black, for example, and the intermediate transfer belt 64 conveys the primarily transferred toner images to the later-described second transfer roll 80. The wrap-in roll 68 and the wrap-out roll 70 are separated from the photoreceptor drum 50.

Further, the intermediate transfer belt 64 is stretched by the six rolls including the wrap-in roll 68, the wrap-out roll 70, the second transfer backup roll 72, the brush backup roll 74, and the tension rolls 75 and 76, and the toner images on the photoreceptor drum 50 are transferred to the intermediate transfer belt 64 by the first transfer roll 66.

Moreover, a planar portion is formed at the back side (surface at the right side in FIG. 1) of the intermediate transfer belt 64 by the tension roll 75 and the second transfer backup roll 72. This planar portion is configured such that it serves as a second transfer portion and faces the conveyance path 28.

The brush backup roll 74 assists a brush roll 86 in scraping off waste toner remaining on the intermediate transfer belt 64 after second transfer.

The second transfer roll 80 faces the second transfer backup roll 72 of the intermediate transfer device 62 with the conveyance path 28 sandwiched therebetween. In other words, the space between the second transfer roll 80 and the second transfer backup roll 72 serves as a second transfer position in the second transfer portion. The second transfer roll 80 is assisted by the second transfer backup roll 72 in secondarily transferring to the paper at the second transfer position the toner images that is primarily transferred to the intermediate transfer belt 64.

The second transfer roll 80 is configured to separate from the intermediate transfer belt 64 during a period of time when the intermediate transfer belt 64 completes three rotations—that is, during the period of time when the intermediate transfer belt 64 conveys the toner images of the three colors of yellow, magenta, and cyan—and to contact the intermediate transfer belt 64 when the toner image of black is transferred.

A predetermined electric potential difference arises between the second transfer roll 80 and the second transfer backup roll 72, and when the second transfer roll 80 is given a high voltage, for example, the second transfer backup roll 72 is connected to a ground (GND) or the like.

An intermediate transfer belt cleaner 82 is disposed at the intermediate transfer belt 64. The intermediate transfer belt cleaner 82 includes a scraper 84, the brush roll 86, and a toner recovery bottle 88, and swings around an unillustrated rotational support shaft. The brush roll 86 scrapes off the waste toner on the intermediate transfer belt 64. The scraper 84 scrapes and cleans off the waste toner adhering to the brush roll 86. The toner recovery bottle 88 recovers the toner scraped off by the scraper 84. The scraper 84 may be a thin plate of stainless steel, for example. Further, the brush roll 86 includes a brush made of acrylic or the like that is treated to make it electrically conductive, for example. Additionally, the brush roll 86 is configured to separate from the intermediate transfer belt 64 while the intermediate transfer belt 64 conveys the toner images and to contact the intermediate transfer belt 64 at a predetermined timing.

Further, a photoreceptor drum cleaner 96 is disposed at the photoreceptor drum 50. The photoreceptor drum cleaner 96 includes a blade 97 and a toner recovery bottle 98. The blade 97 scrapes off the waste toner on the photoreceptor drum 50. The toner recovery bottle 98 recovers the toner scraped off by the blade 97.

Further, a charge roll cleaner 100 is disposed at the charge roll 52. The charge roll cleaner 100 includes a cleaning roll 102 and an unillustrated biasing mechanism. The cleaning roll 102 is biased by the biasing mechanism toward a peripheral surface 52A of the charge roll 52, rotates following the rotation of the charge roll 52, and scrapes and cleans off foreign matter adhering to the peripheral surface 52A of the charge roll 52, such as toner and external additives in the toner.

The fixing device 90 is disposed above the second transfer position. The fixing device 90 includes a heat roller 92 and a pressure roller 94, causes the toner images secondarily transferred to the paper by the second transfer roll 80 and the second backup roll 72 to be fixed to the paper, and conveys the paper to the exit roll 34.

Here, the cleaning of the charge roll 52 will be described.

As mentioned above, the photoreceptor drum cleaner 96 is disposed at the photoreceptor drum 50. The toner remaining on the photoreceptor drum 50 is recovered by the photoreceptor drum cleaner 96. However, there are particles that cannot be completely recovered by the photoreceptor drum cleaner 96, such as external additives in the toner, and these adhere to the peripheral surface 52A of the charge roll 52. For this reason, the peripheral surface 52A of the charge roll 52 is cleaned by the charge roll cleaner 100.

The charge roll 52 is made of rubber with a diameter of 12 mm, an axial length of 314 mm, a volume resistance of $10^6$ log Ω·cm, and a hardness of 65° (ASK-C), is pressed against the photoreceptor drum 50 with a force of 0.09 N, and rotates following the rotation of the photoreceptor drum 50.

The cleaning roll 102 disposed in the charge roll cleaner 100 is made of urethane foam rubber with a diameter of 10 mm and an axial length of 314 mm, is pressed against the peripheral surface 52A of the charge roll 52 such that it has a predetermined interference with the charge roll 52, and rotates following the rotation of the charge roll 52.

Figure 2:
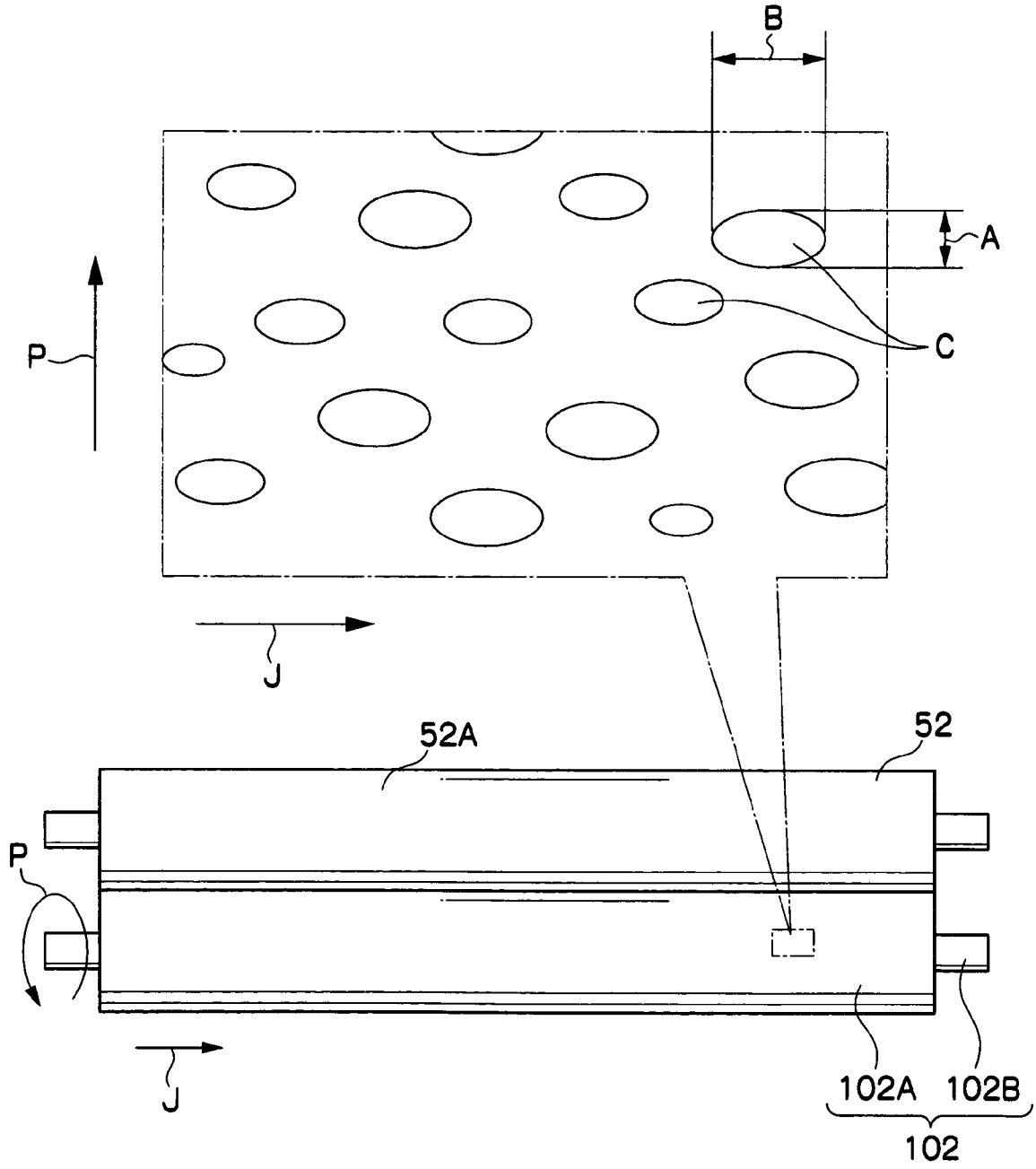
FIG. 2 is a diagram showing the cleaning roll pertaining to the exemplary embodiment of the invention and foam cells in the cleaning roll.
Figure 3:
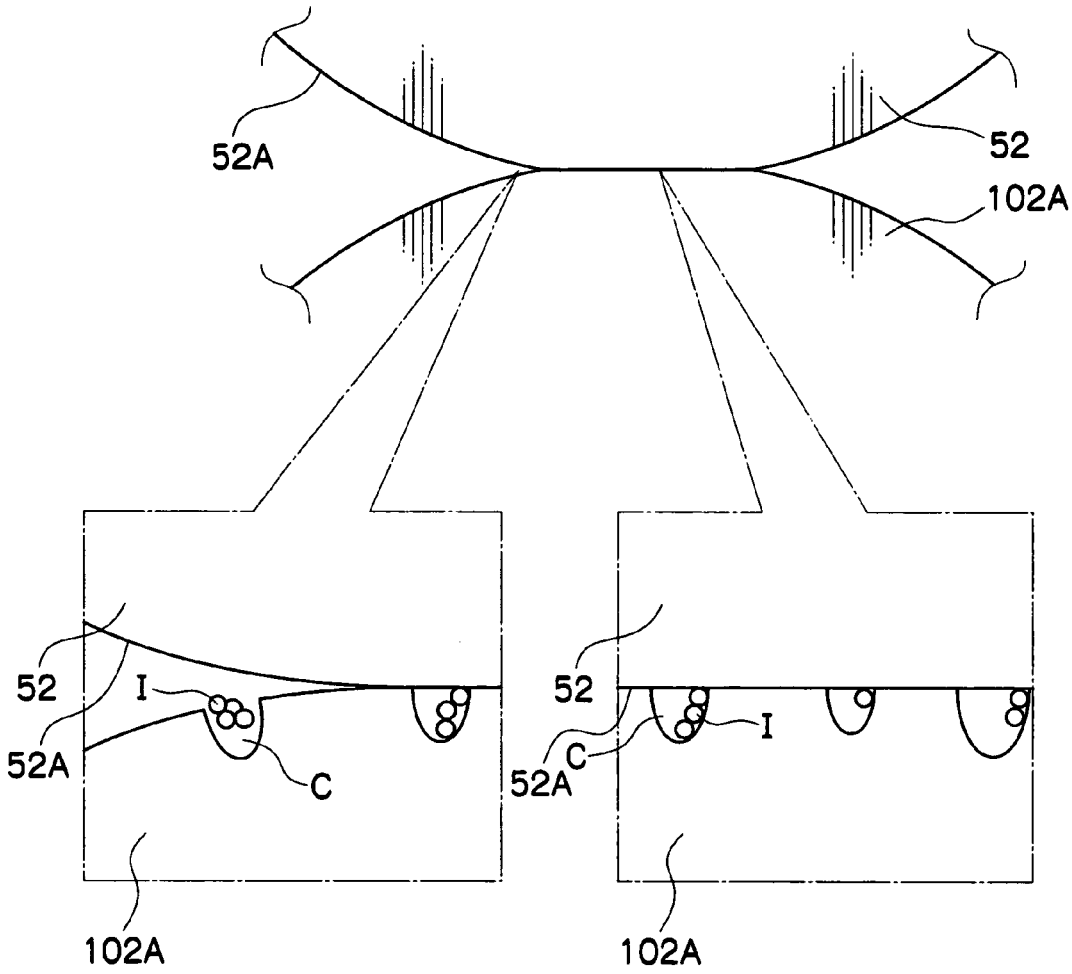
FIG. 3 is a diagram showing a cleaning operation by the cleaning roll pertaining to the exemplary embodiment of the invention.

As shown in FIG. 2, innumerable foam cells C are present in a roll portion 102A of the cleaning roll 102. As shown in FIG. 3, in the nip portion formed between the roll portion 102A of the cleaning roll 102 and the peripheral surface 52A of the charge roll 52, foreign matter I, such as toner, external additives, and dust, is scraped off by the edges of the foam cells C and becomes trapped inside the foam cells C in a certain amount. Then, the foreign matter I trapped inside the foam cells C becomes massed together to form large clumps and is finally expelled from the foam cells C due to rebound when the foam cells C are released from the nip with the peripheral surface 52A of the charge roll 52. Then, the clumps of foreign matter I expelled from the foam cells C are recovered by the photoreceptor drum cleaner 96 and the intermediate transfer belt cleaner 82.

Figure 4:
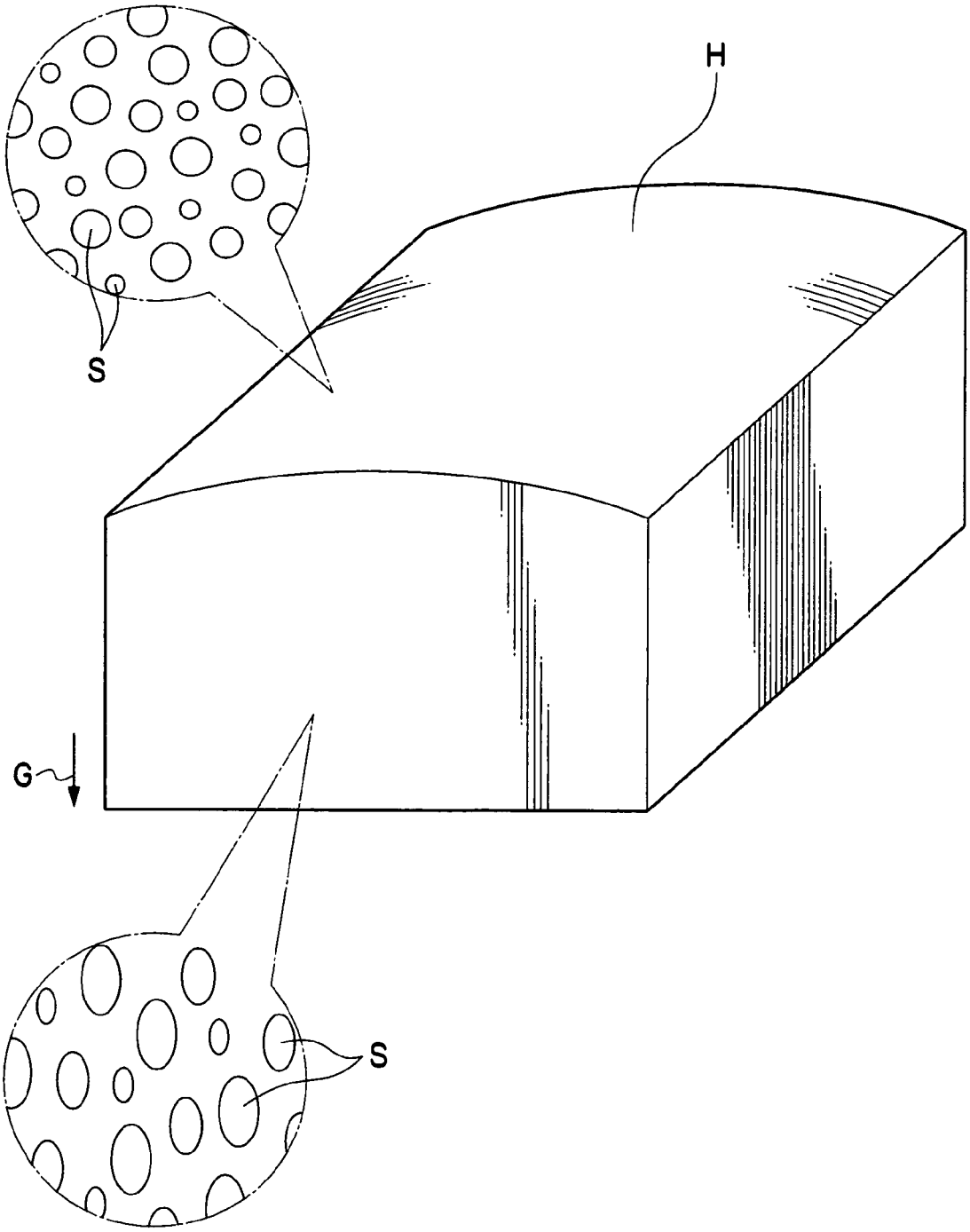
FIG. 4 is a diagram showing foam fabric that is a material of the cleaning roll pertaining to the exemplary embodiment of the invention and foam cells in the foam fabric.

Incidentally, as shown in FIG. 4, a foam fabric H such as urethane foam rubber is formed by conducting foam formation after kneading a material. At this time, due to the action of gravity, bubbles S do not become spherical but rather standing shapes whose cross-sectional shapes in a gravity direction G are circular and whose cross-sectional shapes in the horizontal direction are elliptical. For this reason, as shown in FIGS. 2 and 4, differences emerge in the shapes and dimensions of the foam cells C in the roll portion 102A due to the relationship between an axial direction J of the roll portion 102A and the gravity direction G of the foam fabric H. For example, when the axial direction J of the roll portion 102A and the gravity direction G of the foam fabric H are perpendicular, the foam cells C have circular or elliptical shapes whose longitudinal axis direction is in a circumferential direction (process direction) P. That is, the ratio A/B between the diameter A of the foam cells C in the process direction P and the diameter B of the foam cells C in the axial direction J is such that $A/B \geqq 1.0$. In contrast, when the axial direction J of the roll portion 102A and the gravity direction G of the foam fabric H are parallel, the foam cells C have elliptical shapes whose longitudinal axis direction is in the axial direction J. That is, the ratio A/B between the diameter A of the foam cells C in the process direction P and the diameter B of the foam cells C in the axial direction J is such that $A/B<1.0$.

Here, between when A/B is such that $A/B<1.0$ and when A/B is such that $A/B \geqq 1.0$, the breadth of the edges of the foam cells C in the axial direction J becomes larger when $A/B<1.0$. Hence, it may be predicted that the range of each foam cell C contributing to cleaning will become wider and that the cleaning performance will become higher, and an experiment for substantiating this prediction is conducted.

In this experiment, two types of foam fabrics H are used as samples and their cleaning performance is evaluated when A/B is such that $A/B<1.0$ and when A/B is such that $A/B \geqq 1.0$. The two types of samples are both urethane foam rubber, but in one sample ("sample 1" below) the number of foam cells C is 40 cells/25 mm and the compression load (load at the time of 0.5 mm compression) is 0.013 to 0.014 N, and in the other sample ("sample 2" below) the number of cells is 60 cells/25 mm and the compression load is 0.008 to 0.010 N.

Further, samples 1 and 2 are used to create cleaning rolls 102 in which A/B is such that $0.5<A/B<1.0$ or $1.0 \leqq A/B<1.3$. That is, four types of cleaning rolls 102 are created.

Further, the cleaning performance evaluation is conducted by a method where the charge roll 52, which is dirtied in advance, is prepared, cleaned for a certain period of time by the cleaning rolls 102, and then compared with a boundary sample.

The preparation of the dirtied charged roll 52 is conducted by a method where a halftone image with a Cin (density) of 50% is printed on 1000 sheets of paper in a state where the charge roll cleaner 100 is not installed.

Further, in the cleaning, the interference of the cleaning roll 102 with the peripheral surface 52A of the charge roll 52 is varied between 0.25, 0.5, 0.75, 1.0, and 1.25, and the charge roll 52 is rotated to complete 960 rotations at 165 mm/s with respect to each interference.

Figure 5A:
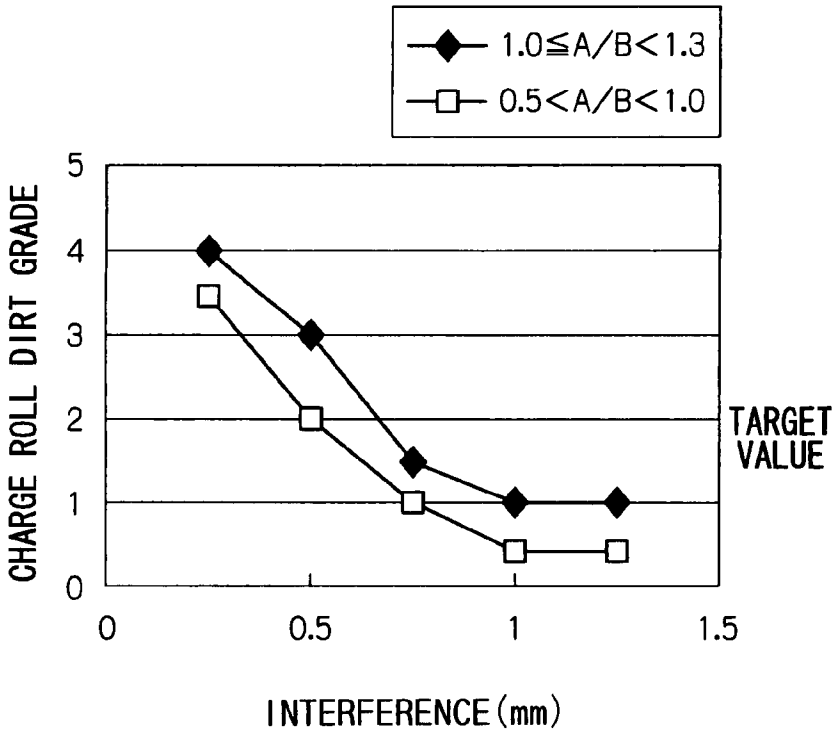
FIGS. 5A and 5B are graphs showing the results of an evaluation of the cleaning performance of the cleaning roll pertaining to the exemplary embodiment of the invention.

As a result, as shown in the graph of FIG. 5A, in the cleaning rolls 102 using sample 1, when A/B is such that $0.5<A/B<1.0$, by making the interference 0.5 mm, the grade of the dirt on the peripheral surface 52A of the charge roll 52 may be lowered to a target level, but when A/B is such that $1.0 \leqq A/B<1.3$, the grade of the dirt on the peripheral surface 52A of the charge roll 52 may not be lowered to the target level unless the interference is raised to 0.7 mm and the nip pressure is raised.

Figure 5B:
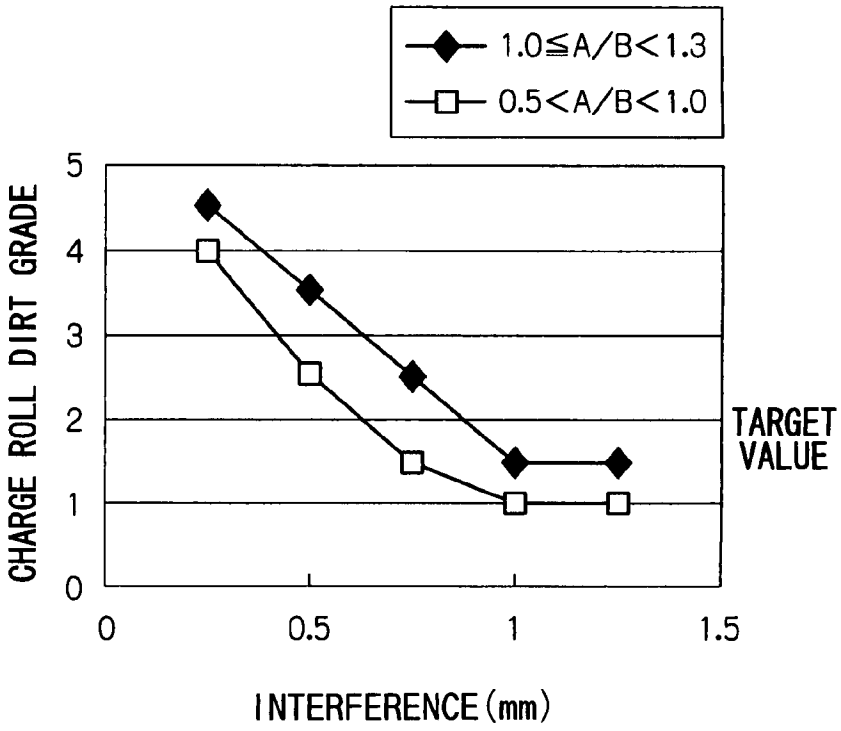

Further, as shown in the graph of FIG. 5B, in the cleaning rolls 102 using sample 2, when A/B is such that $0.5<A/B<1.0$, by making the interference 0.7 mm, the grade of the dirt on the peripheral surface 52A of the charge roll 52 may be lowered to the target level, but when A/B is such that $1.0 \leqq A/B<1.3$, the grade of the dirt on the peripheral surface 52A of the charge roll 52 may not be lowered to the target level unless the interference is raised to 0.9 mm and the nip pressure is raised.

From the above, it is confirmed that the cleaning performance may be improved by making A/B such that $A/B<1.0$. For this reason, in this exemplary embodiment, in the portion where the charge roll 52 and the cleaning roll 102 contact each other and the portion where the charge roll 52 and the cleaning roll 102 do not contact each other, the ratio A/B between the diameter A of the foam cells C in the process direction P and the diameter B of the foam cells C in the axial direction J is set to $A/B<1.0$. Further, the number of foam cells C satisfying the relationship of $A/B<1.0$ is set to be greater than the number of foam cells C satisfying the relationship of $A/B \geqq 1.0$.

Further, by setting A/B to $A/B<1.0$, there is the effect that the foreign matter I recovered inside the foam cells C continues to be retained as a result of the foam cells C being smashed in the circumferential direction of the charge roll 52 at the nip portion when the cleaning roll 102 rubs against the charge roll 52. Further, it becomes easy to expel the massed-together clumps of foreign matter I with the reaction force resulting from the foam cells C rebounding to their initial shapes when the foam cells C separate from the nip portion.

Figure 6:
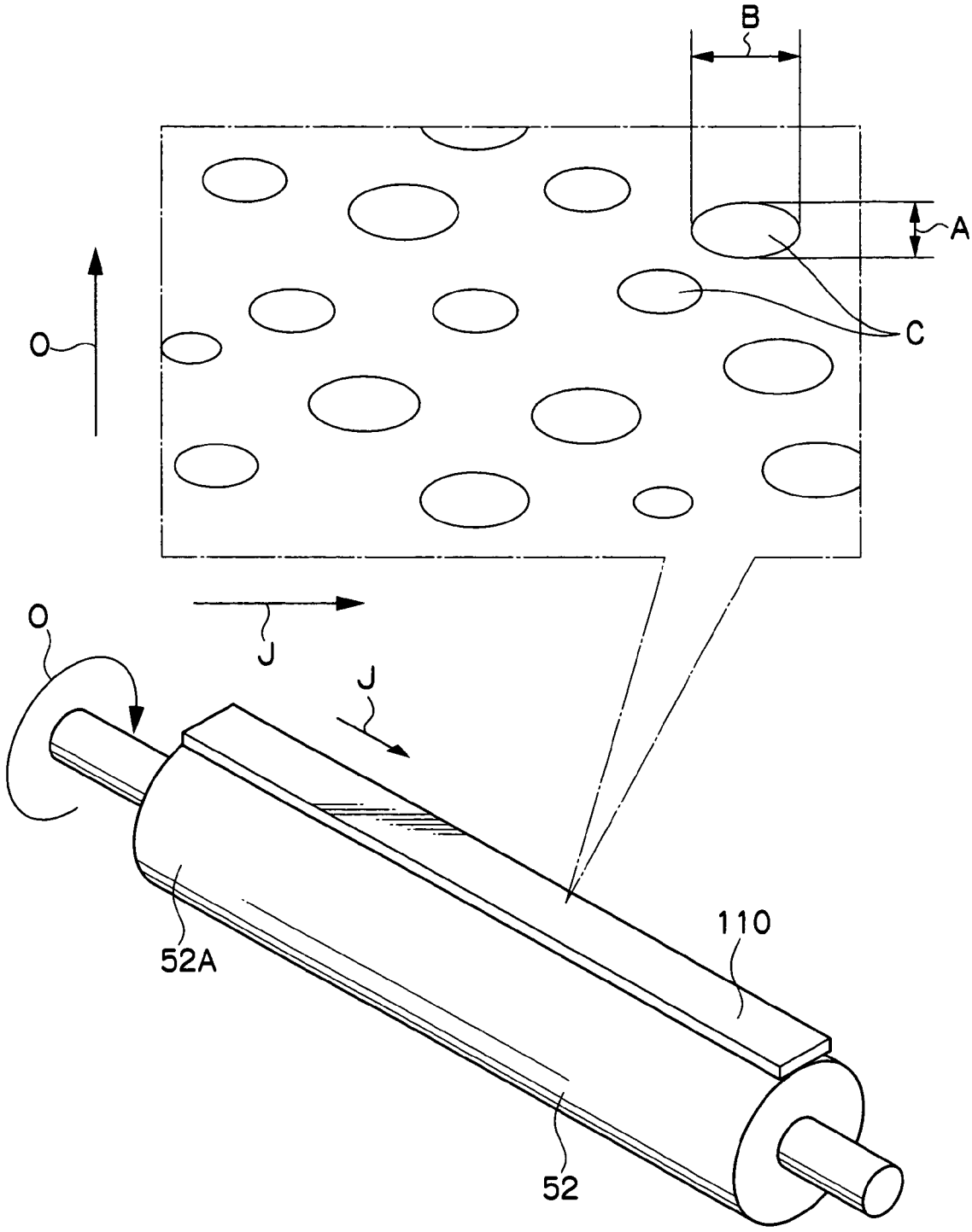
FIG. 6 is a diagram showing a cleaning pad pertaining to a modification of the exemplary embodiment of the invention and foam cells in the cleaning pad.

In this exemplary embodiment, an aspect of the present invention is described using the cleaning roll 102 as an example, but the aspect of the present invention is not limited to this. As shown in FIG. 6, the aspect of the present invention is also applicable to a cleaning pad 110 that extends in the axial direction of the charge roll 52 and rubs against the peripheral surface 52A of the charge roll 52. In this case, the cleaning pad 110 may be formed by foam material, and the ratio A/B between the diameter A of the foam cells C in the circumferential direction O of the charge roll 52 and the diameter B of the foam cells C in the axial direction J of the charge roll 52 may be set to $A/B<1.0$.

Figure 7:
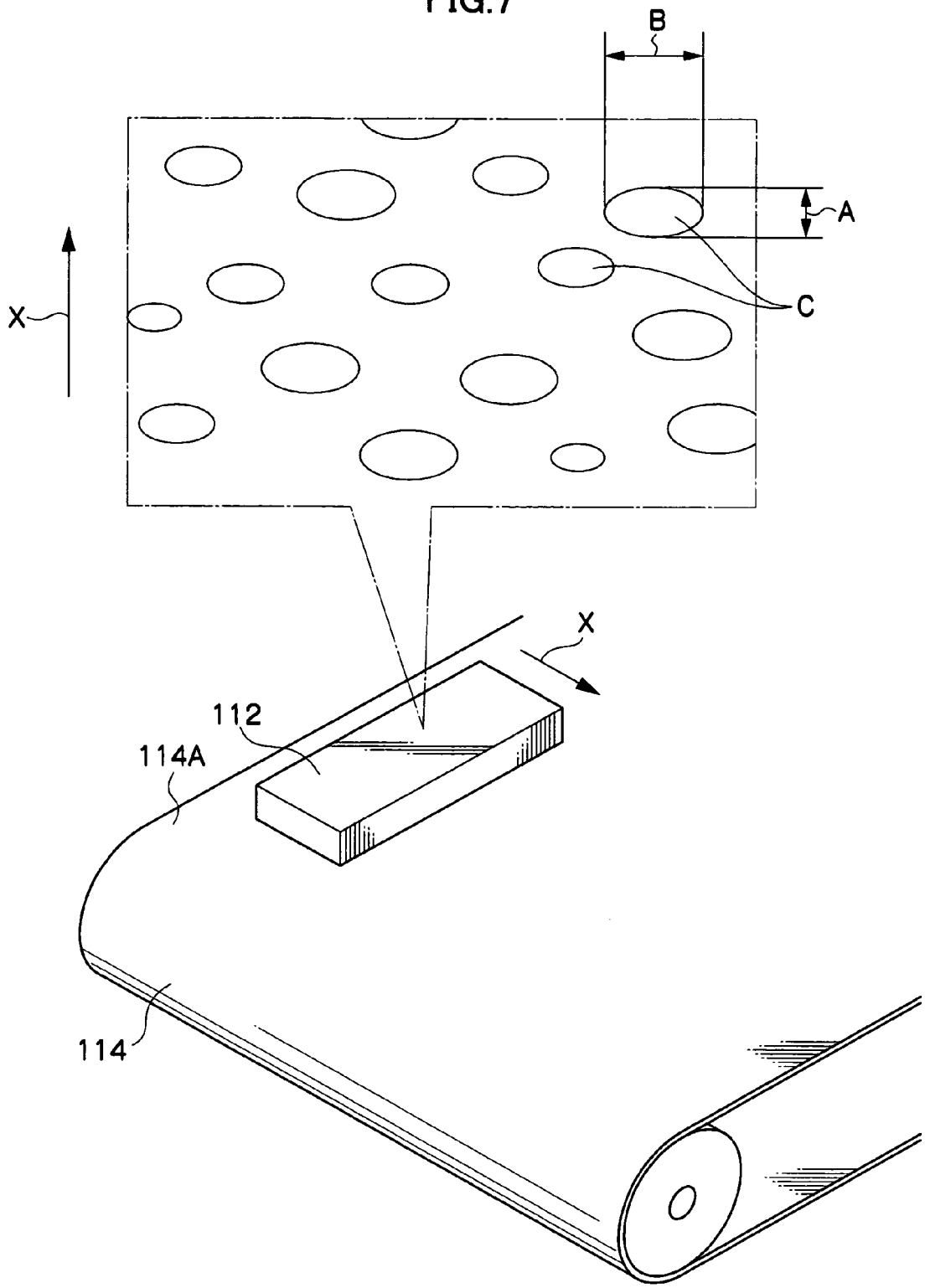
FIG. 7 is a diagram showing a cleaning member pertaining to a modification of the exemplary embodiment of the invention and foam cells in the cleaning member.

Further, in this exemplary embodiment, the aspect of the present invention is described by way of an example where the charge roll 52 is cleaned as a result of the peripheral surface 52A, which is a member to be cleaned, being moved by rotation, but the cleaning member may also be moved relative to the member to be cleaned. For example, as shown in FIG. 7, a cleaning member 112 may be moved to clean a member to be cleaned 114A of a member 114. In this case, the ratio A/B between the diameter A of the foam cells C in the moving direction X of the cleaning member 112 and the diameter B of the foam cells C in the direction orthogonal to the moving direction X of the cleaning member 112 may be set to A/B<1.0.

Further, in this exemplary embodiment, the aspect of the present invention is described using as an example a cleaning member that cleaned the peripheral surface 52A of the charge roll 52, but the aspect of the present invention is not limited to this. The aspect of the present invention is also applicable to cleaning members that clean members to be cleaned of other members, such as the photoreceptor drum 50 and the intermediate transfer belt 64.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. An image forming apparatus comprising:

a member to be cleaned; and a cleaning member, formed by foam material having a plurality of foam cells, that cleans the member to be cleaned by contacting the member to be cleaned and rubbing against the member to be cleaned, wherein when A represents a maximum length in a rubbing direction and B represents a maximum length in a direction orthogonal to the rubbing direction in any one of the plurality of foam cells in a surface of the cleaning member, the number of foam cells satisfying the relationship of A<B is greater than the number of foam cells satisfying the relationship of A≧B in the surface of the cleaning member.

2. The image forming apparatus of claim 1, wherein the member to be cleaned comprises a charge roll that charges an image carrier.

3. The image forming apparatus of claim 1, wherein the cleaning member comprises a roll.

4. The image forming apparatus of claim 1, wherein the cleaning member comprises a pad.

5. The image forming apparatus of claim 1, wherein the cleaning member comprises urethane foam rubber.

6. The image forming apparatus of claim 1, wherein the foam cells are in a surface of the cleaning member at a portion where the cleaning member contacts the member to be cleaned.

7. The image forming apparatus of claim 1, wherein the foam cells are in a surface of the cleaning member at a portion where the cleaning member does not contact the member to be cleaned.

* * * * *